US005833289A

United States Patent [19]

Brolin

[11] Patent Number: 5,833,289

[45] Date of Patent: Nov. 10, 1998

[54] MODULAR STORAGE SYSTEM FOR STACKING CYLINDRICAL LOADS

[76] Inventor: Walter G. Brolin, P.O. Box 480, North Hampton, N.H. 03862-0480

[21] Appl. No.: 686,057

[22] Filed: Jul. 24, 1996

[51] Int. Cl.[6] ..... B66C 1/22; B65D 21/032

[52] U.S. Cl. ..... 294/68.1; 294/67.1; 108/55.1; 410/50

[58] Field of Search ..... 294/67.1, 67.4, 294/67.41, 68.1, 68.26, 68.3; 410/47–50, 155; 108/55.1, 55.3, 55.5; 206/389, 393, 394, 446, 509, 512; 211/85.5, 194; 220/1.5

[56] References Cited

U.S. PATENT DOCUMENTS

| | | | |
|---|---|---|---|
| 1,940,242 | 12/1933 | Burgess | 214/9 |
| 2,262,794 | 11/1941 | Burbank et al. | 248/120 |
| 2,472,843 | 6/1949 | Muise | 294/67.4 |
| 2,632,567 | 3/1953 | Richtmyer | 108/55.1 |
| 2,828,023 | 3/1958 | Berra et al. | 410/48 |
| 2,962,167 | 11/1960 | Storey et al. | 211/85.5 |
| 3,084,803 | 4/1963 | Bayers | 410/48 |
| 3,157,424 | 11/1964 | Hall | 294/67 |
| 3,430,773 | 3/1969 | Hancock | 211/85.5 |
| 3,476,260 | 11/1969 | Jay | 211/71 |
| 3,502,205 | 3/1970 | Milton | 294/67.41 |
| 3,844,600 | 10/1974 | Jay | 294/67 |
| 4,008,669 | 2/1977 | Sumrell | 410/47 |
| 4,068,971 | 1/1978 | McNeill | 294/67 |
| 4,191,415 | 3/1980 | Frei | 294/67 |
| 4,257,523 | 3/1981 | Blasio | 206/303 |
| 4,295,431 | 10/1981 | Stavio | 294/67.1 |
| 4,339,047 | 7/1982 | Johansson et al. | 206/512 |
| 4,796,540 | 1/1989 | Pelfrey | 108/55 |
| 5,228,821 | 7/1993 | Gleffe et al. | 414/403 |
| 5,588,372 | 12/1996 | Kelly | 108/55.1 |

OTHER PUBLICATIONS

Brochure entitled "HF Stacking Cradle System" by W.A. Schmidt, Horsham, PA 19044.

*Primary Examiner*—Dean Kramer
*Attorney, Agent, or Firm*—Benita J. Rohm; Raphael A. Monsanto

[57] ABSTRACT

A system for stacking cylindrical or coiled materials includes a plurality of interengaging modules for supporting and storing the cylindrical materials. Each module includes a base having four corners. Each module further includes four stanchions disposed at respective ones of the four corners of the base. Each stanchion is connected to the base at a lowermost end thereof and additionally includes a guide protuberance that in certain embodiments is tapered or arranged at an angle with respect to the associated stanchions. The four stanchions are arranged in two pairs such that the two pairs of stanchions are disposed on opposing sides of the base. The modules also comprise two lifting members, each such lifting member being disposed between the paired stanchions and includes an arrangement for distributing load. Each module is provided with a plurality of slots in the base for interengaging with guide protuberances associated with another of the modules. The slots are disposed in spaced relation in the vicinity of the lowermost ends of respective ones of the stanchions.

22 Claims, 6 Drawing Sheets

FIG. 5
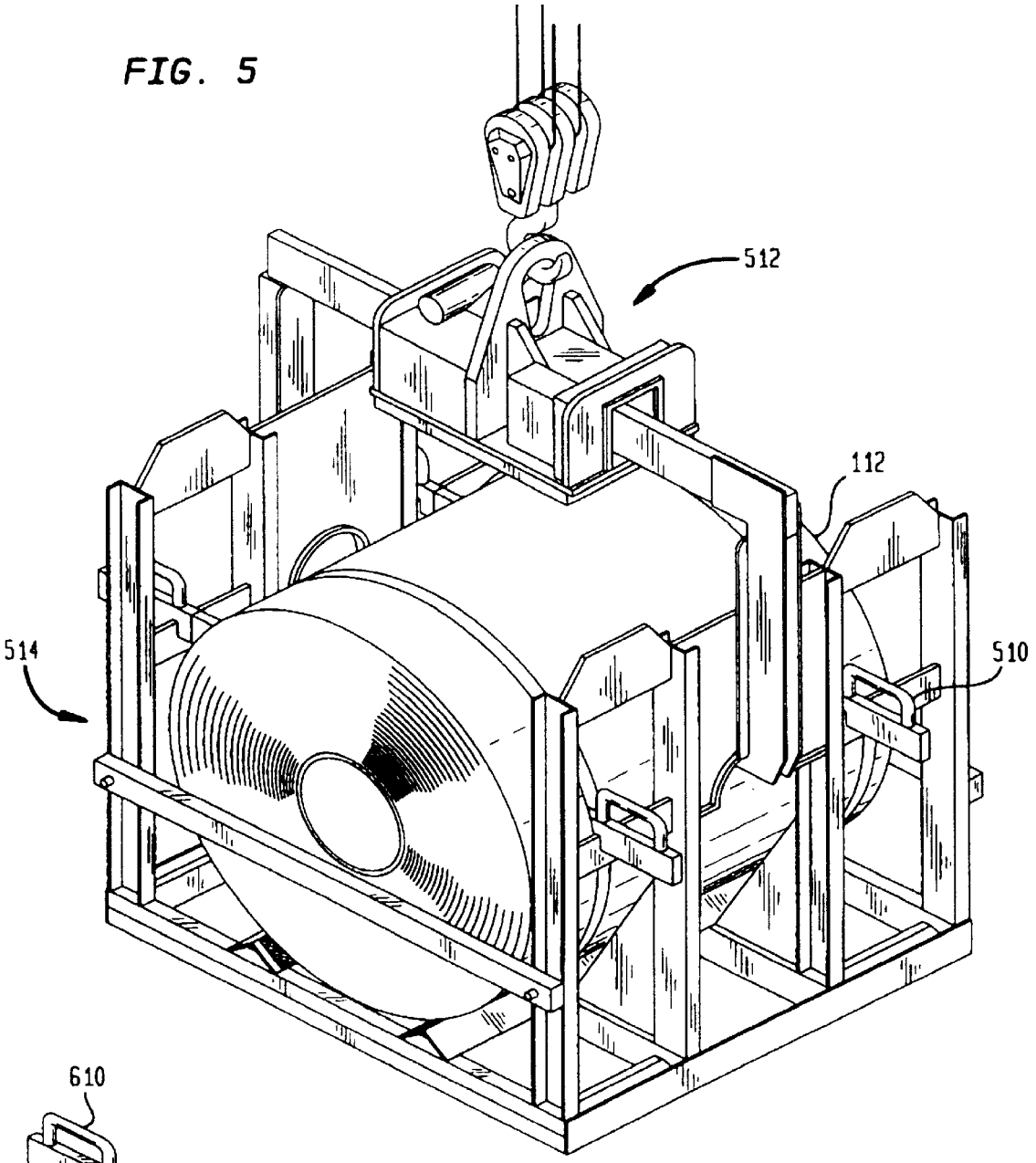
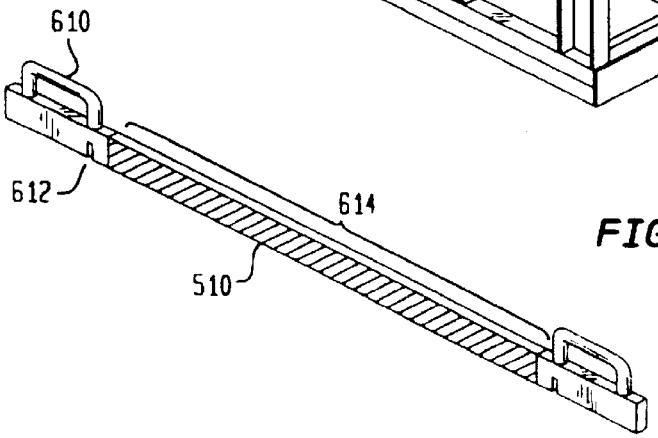
FIG. 6

MODULAR STORAGE SYSTEM FOR STACKING CYLINDRICAL LOADS

BACKGROUND OF THE INVENTION

1. Field of the Invention

This invention relates generally to storage racks and containers, and more specifically, to a modular storage container for storing, transporting, and stacking cylindrical loads.

2. Description of the Related Art

The distribution of cylindrical loads, such as flat rolled steel coils, from a producer to an end-user has long been a challenging task with respect to material handling, warehousing and transportation. Due to the large size and awkward shape of these coils handling and transporting coiled materials has been difficult. These coils are large enough to require the use of a crane or other automated lifting apparatus when transporting or handling same, but such coils also have fragile edges that may be easily damaged.

Warehousing presents further problems in storing coiled materials. Floor space is generally expensive, and therefore, at a premium. The large dimensions of coiled materials makes it desirable to employ a system of modular containers that may be stacked, thereby conserving valuable floor space. Unfortunately, the size and weight of the coils severely limit the number of coils that may be stacked due to safety concerns. Although coils may be stacked in a pyramid fashion without the use of a container, this practice is unsafe and likely to cause damage to coils of thin gauge material.

Examples of prior art storage containers described in U.S. Pat. Nos. 2,262,794, 3,844,600 and 4,191,415. These and other prior art storage containers have certain shortcomings that are addressed and overcome by the present invention. These shortcomings are summarized as follows:

1. containers do not fully protect unbalanced loads;
2. containers generally are difficult to stack;
3. transportation often causes damage to coiled materials; and
4. coil lifters often damage the inner surfaces and the edges of coiled materials.

There is a need for a system of storage containers that provides greater flexibility in handling coiled material than presently is available. There is also a need for a storage container that protects and accommodates unevenly distributed weight of loads. There is a further need for a storage container that can easily and safely be stacked. There is yet another need for a storage container that protects the load from material damage due to impact and/or vibration. There is a still further need for a storage container that protects the coiled material load against damage to the inner and outer diameter of the coil as well as the edges.

SUMMARY OF THE INVENTION

It is an object of the present invention to provide a modular system for stacking cylindrical loads that protects and accommodates unevenly distributed loads.

It is another object of the present invention to provide a modular system for stacking cylindrical loads that can be safely and easily stacked.

It is a further object of the present invention to provide a modular system for stacking cylindrical loads that protects the cylindrical loads from damage resulting from impact and/or vibration.

It is yet a further object of the present invention to provide a modular system for stacking cylindrical loads that protects against damage to the inner and outer surfaces as well as the edges of the coiled material.

The foregoing and other objects are achieved by the present invention which provides a system for stacking cylindrical loads. In accordance with the invention, the system is provided with a plurality of stackable modules for containing the cylindrical loads. Each module includes a generally rectangular base having four corners. At each of the four corners of the base there is disposed a stanchion that is connected at its lowermost end to the base. The four stanchions are arranged in two pairs disposed along opposing sides of the base.

The stanchions within a pair of stanchions are connected to one another by a lifting member. The lifting member includes an arrangement for distributing and/or stabilizing the load carried within the module. Further, each stanchion includes an associated guide protuberance attached thereto. The stacking of multiple modules is facilitated by a receptacle in the base for receiving a respective guide protuberance associated with a further one of the modules. This receptacle for receiving the guide protuberance is disposed in the vicinity of the lowermost end of each stanchion and is in spaced relation to the associated guide protuberance, which in one specific illustrative embodiment of the invention, is attached at the upper end of the stanchion.

BRIEF DESCRIPTION OF THE DRAWINGS

Comprehension of the invention is facilitated by reading the following detailed description, in conjunction with the annexed drawings, in which:

FIG. 5 is an isometric representation of an alternative embodiment of a storage module having a slit coil separator in accordance with the present invention;

FIG. 6 is an enlarged isometric representation of a separator mechanism in accordance with the present invention;

DETAILED DESCRIPTION

Figure 1:
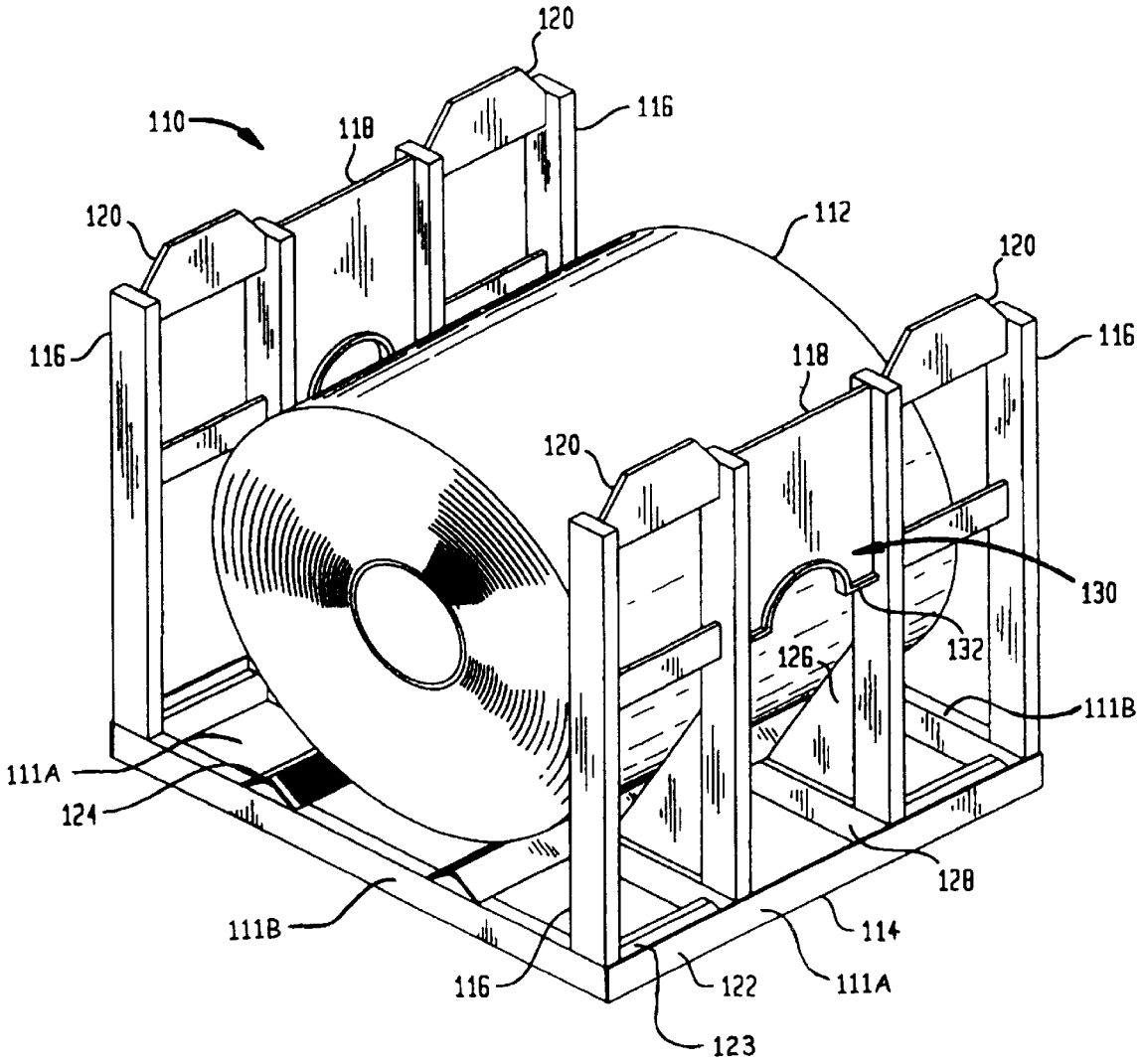
FIG. 1 is an isometric representation of a storage module constructed in accordance with the present invention.

FIG. 1 an isometric representation that shows a module 110 for handling, transporting, and storing cylindrical load 112 in accordance with the present invention. All elements of module 110 are secured together, such as by welding, to form an integral unit. In this specific illustrative embodiment, module 110 includes a base 114 that is constructed to have four sides made of channel or tubular steel in opposed pairs 111A and 111B. Base 114 includes a saddle formed by a pair of beveled rails 124. These inverted v-shaped rails allow module 110 to accommodate cylindrical loads having various specifications such as outer diameter, width, and weight. In some embodiments, rails 124 may include a protective lining (not shown) to reduce the risk of damage to cylindrical load 112.

Module 110 further includes four upright stanchions 116 that are attached to base 114 at each of the four corners. In this specific illustrative embodiment of the invention each stanchion 116, is constructed using two flat steel bars separated and supported by a lateral support member. Each stanchion 116 is further supported by a brace 126 and a cross member 128 of base 114.

As shown, stanchions 116 are arranged into two pairs, the stanchions serving as upstanding protective side members that further reduce the risk of damage to cylindrical load 112. Each pair of stanchions 116 is disposed along opposing sides of base 114. The stanchions 116 of each pair are connected by a lifting member 118. Lifting member 118 facilitates lifting of module 110 by an overhead coil lifter (not shown). When module 110 is lifted, the lowermost edges of lifting members 118 bear the full load of module 110 and cylindrical load 112. As generally shown at reference numeral 130, lifting member 118 includes an arrangement for stabilizing module 110, shown in the figure as a contoured lowermost edge. To provide reinforcement of the load-bearing lowermost edge, lifting member 118 is provided with an edge support 132.

Module 110 includes two elements which promote safe and efficient stacking of modules. These include a guide protuberance 120 and a guide protuberance receptacle 122 which is formed of one channel of channel pair 111A on the outside and a retention plate 123 on the inside. The retention plate has a working surface that communicates with the guide protuberance during interlocking engagement, as described herein. In other embodiments, guide protuberance receptacle 122 is formed as a slot in the side channels. Four such guide protuberance receptacles are provided in this embodiment, one on each corner of base 114. In this specific illustrative embodiment of the invention, four guide protuberances 120 of module 110, shown here as guide plates, are attached to each stanchion 116 at the uppermost end of the stanchion 116. Also in this specific illustrative embodiment of the invention, the guide plates are each shown to have tapered engagement portions. The four receptacles 122 of module 110 are located at the lowermost portion of module 110 in vertical alignment with guide protuberances 120. As shown here, each receptacle is embodied as a slot in base 114 and interengages with a corresponding guide protuberance of another module (not shown in this figure), whereby the guide protuberances function as interlocking arrangements with the receptacles.

Figure 2:
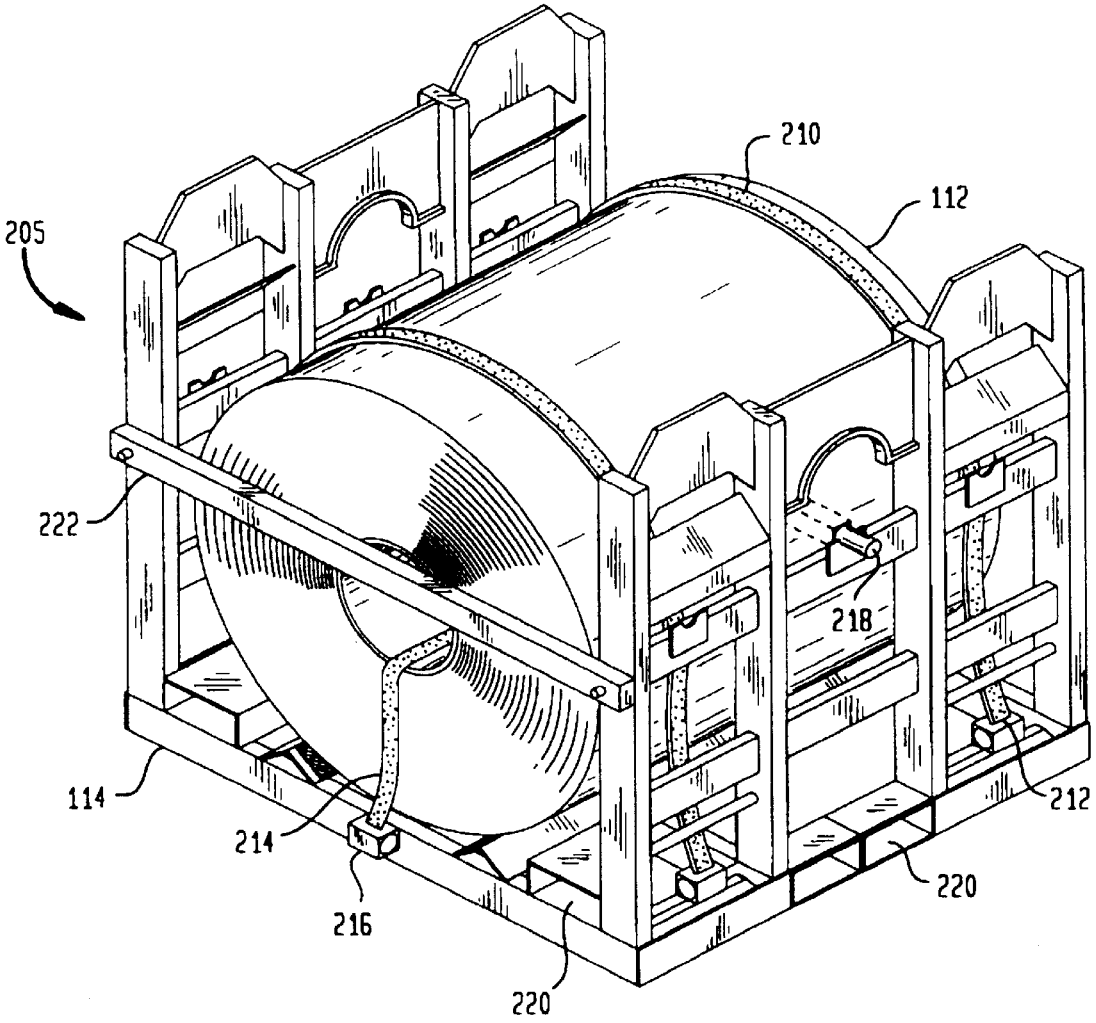
FIG. 2 is an isometric representation of a specific illustrative embodiment of the invention showing a storage module.

FIG. 2 illustrates a preferred embodiment of the invention. Module 205 includes two retention straps 210 for securing cylindrical load 112 within module 205. Straps 210 hold load 112 in place by applying circumferential force along the outer surface of load 112. Straps 210 are fastened to module 205 via ratchet fasteners 212. As illustrated, fasteners 212 are attached to base 114 in proximity to stanchions 116. Similarly, module 205 includes strap 214 for securing cylindrical load 112 along the inner diameter of load 112. Strap 214 is fastened to module 205 via ratchet fastener 216. Straps 210 and 214 prevent load 112 from rolling within module 205 and effectively make load 112 an integral part of module 205. To secure load 112, module 205 includes an end stop bar 222 to prevent load 112 from shifting or sliding laterally within module 205.

An additional element of module 205 is a separator mechanism 218 that provides spacing and lateral support for slit coil loads (not shown in this figure). Separator mechanism 218 includes a separator bar that may be placed in one of three positions, as shown in FIG. 2. Module 205 further includes slots 220 that allow module 205 to be lifted and transported using a forklift or other similar mechanized material handler.

Figure 3:
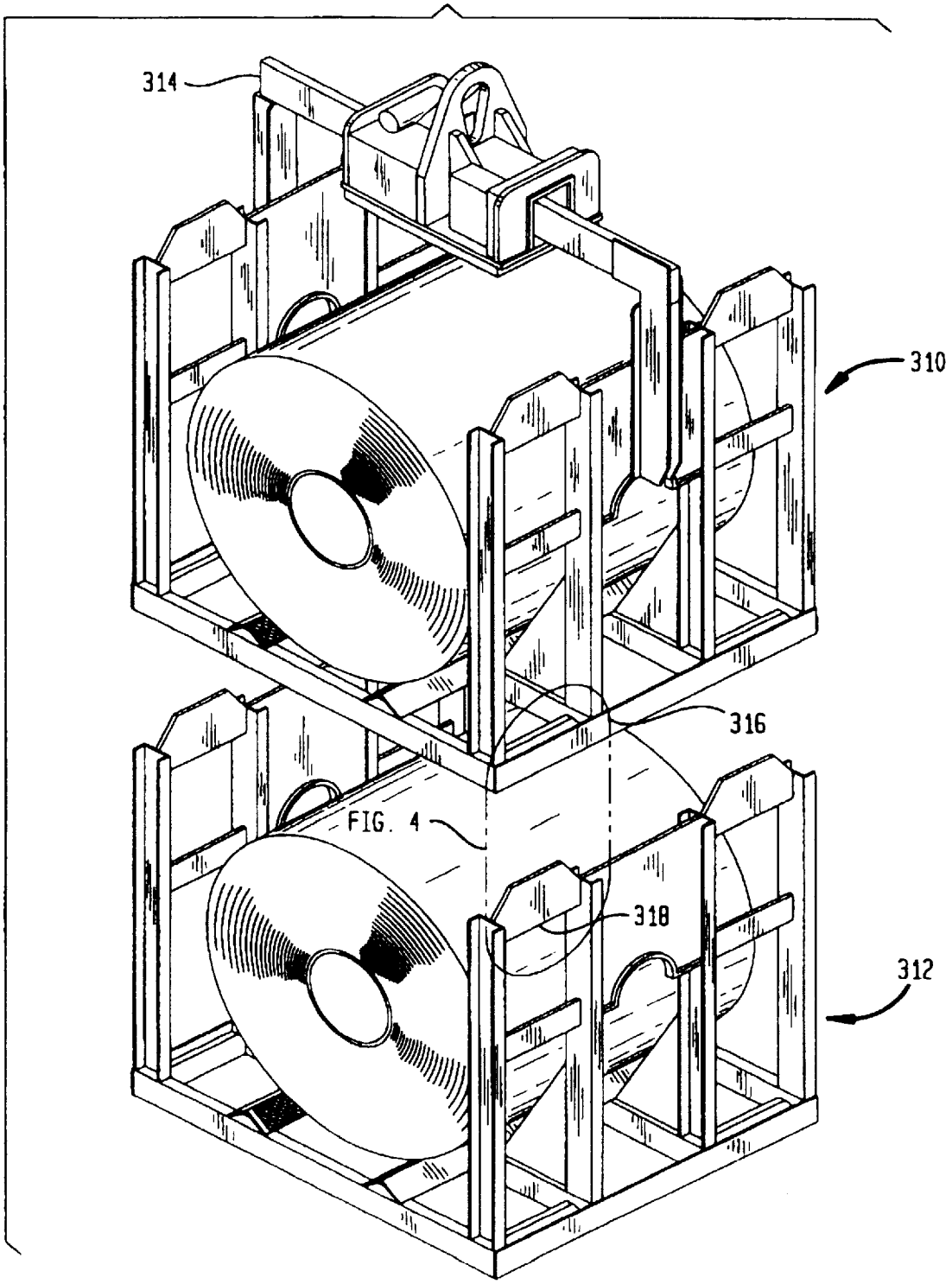
FIG. 3 is an isometric representation of two modules aligned for stacking in accordance with the principles of the present invention.

FIG. 3 is an isometric representation of two modules 310 and 312 aligned for stacking in accordance with the present invention. As shown, coil lifter arm 314 engages the lifting member of module 310 to support module 310. Module 310 is shown to be supported in substantially the same vertical orientation as module 312. A guide plate receiving slot 316 of module 310 is vertically aligned with a guide plate 318 of module 312. As coil lifter 314 lowers module 310 onto module 312, slot 316 engages with guide plate 318 as previously described.

Figure 4:
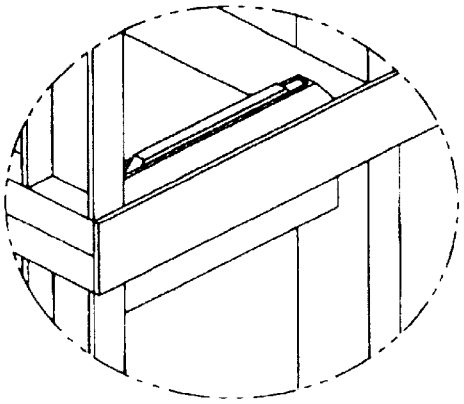
FIG. 4 is an enlarged isometric representation that illustrates the interengagement between the guide protuberance of a first module and the means for receiving same of a second module.

The interengagement of modules 310 and 312 is illustrated the enlargement of FIG. 4. As shown, when module 310 and 312 are vertically stacked, slot 316 of the module 310 slides over guide plate 318 of module 312 until the bottom of module 310 rests on the top of the stanchions of module 312. Once the stacked modules are in place, guide plate 318 laterally supports the system of stacked modules, thereby providing structural integrity to the stacked pair of modules. The engagement of guide plate 318 with slot 316 prevents stacked module 310 from becoming displaced and possibly falling off of module 312. Guide plate 318 and slot 316 also provide alignment guidance during the stacking process. As module 310 is lowered onto module 312, guide plate 318, having tapered corners, urges module 310 into a desired aligned position, whereby module 310 is then safely stacked on module 312.

FIG. 5 is an isometric representation that illustrates a further embodiment of the invention in the form of an alternative module 514. Module 514 is shown in the figure to be suspended by spreader beam 512. In this specific illustrative embodiment of the invention, module 514 includes alternative separator mechanism 510 that provides spacing and lateral support for slit coil loads. Separator mechanism 510, which is shown in greater detail in FIG. 6, is in the form of a flat elongated bar. Separator mechanism 510 includes hand grabs 610 that facilitate insertion and removal of the bar. The separator mechanism further includes notches 612 for stabilizing the bar when it is inserted in a slit coil load. In one embodiment, notches 612 cooperate with corresponding notches (not shown) in module 514. Separator mechanism 510 is provided with a protective lining 614 that reduces the risk of damage to the edges of coiled material 112.

Figure 7:
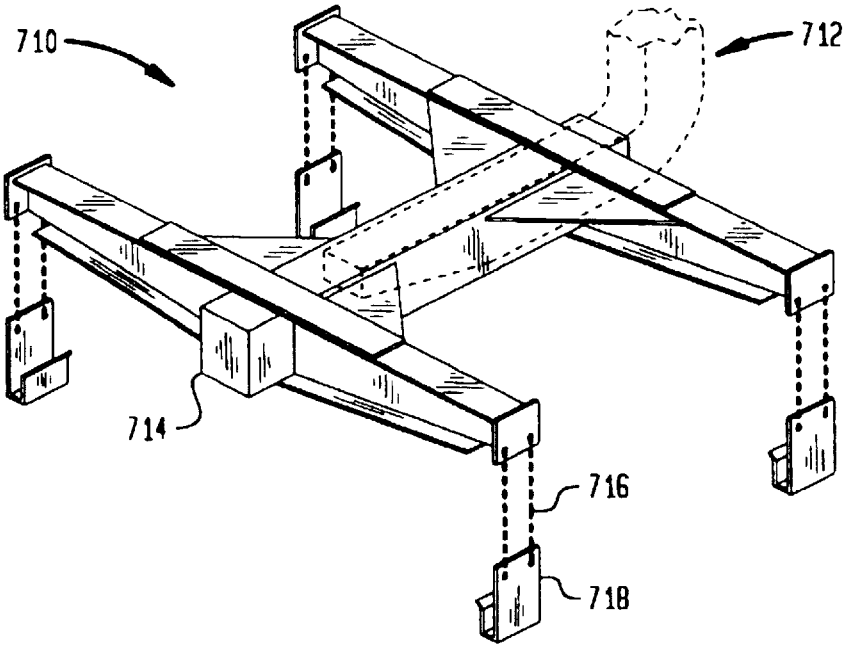
FIG. 7 is an isometric representation of a "C" hook container lifter attachment in accordance with the present invention.

FIG. 7 is an isometric representation of a C-hook coil lifter adapter, generally referred to by reference numeral 710, for use in accordance with the present invention. Standard C-hook lifter 712 is depicted by phantom lines. C-hook 712 represents a conventional mechanism for lifting coiled loads by their inner surfaces. As shown, receptacle 714 of adapter 710 fits over the lower portion of C-hook 712. Adapter 710 includes adjustable support chains 716 and support hooks 718. Support hooks 718 engage a module in accordance with the present invention to support and transport the stored coiled material. Use of adapter 710 prevents damage to the inner surface of the coiled material 112. Adapter 710 is particularly useful in lifting modules in accordance with the present invention.

Figure 8:
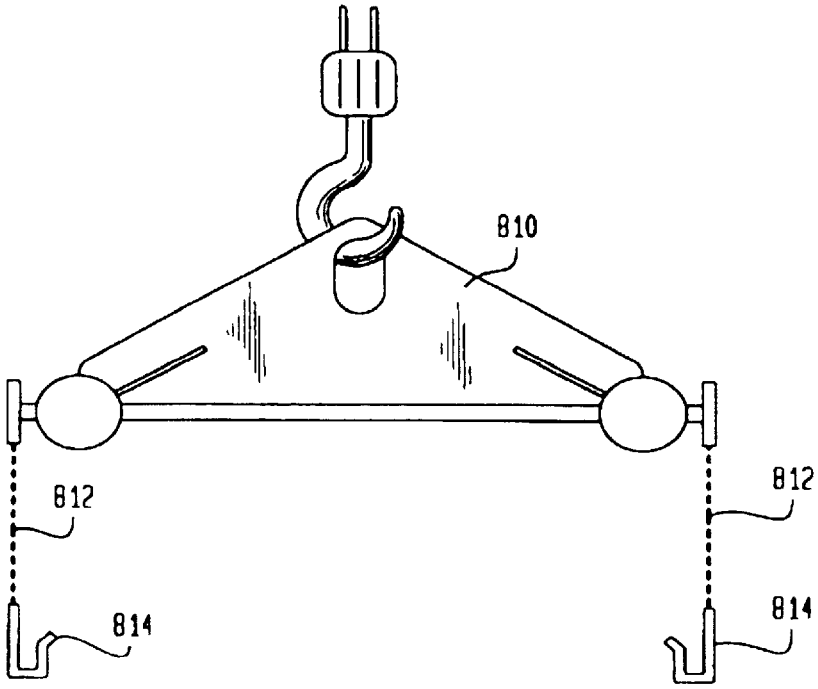
FIG. 8 is an elevational representation of a spreader beam used in accordance with the present invention.

FIG. 8 is a representation of a spreader beam 810 that is useful to lift and transport the modules of the present invention. Spreader beam 810 includes adjustable support chains 812 and support hooks 814. Support hooks 814 engage a module (not shown in this figure) in accordance with the present invention at a lifting point such as under lifting member 118 of module 110 to support and transport the stored coiled material. Use of spreader beam 810 in cooperation with the module of the present invention prevents damage to the coiled material 112.

Figure 9:
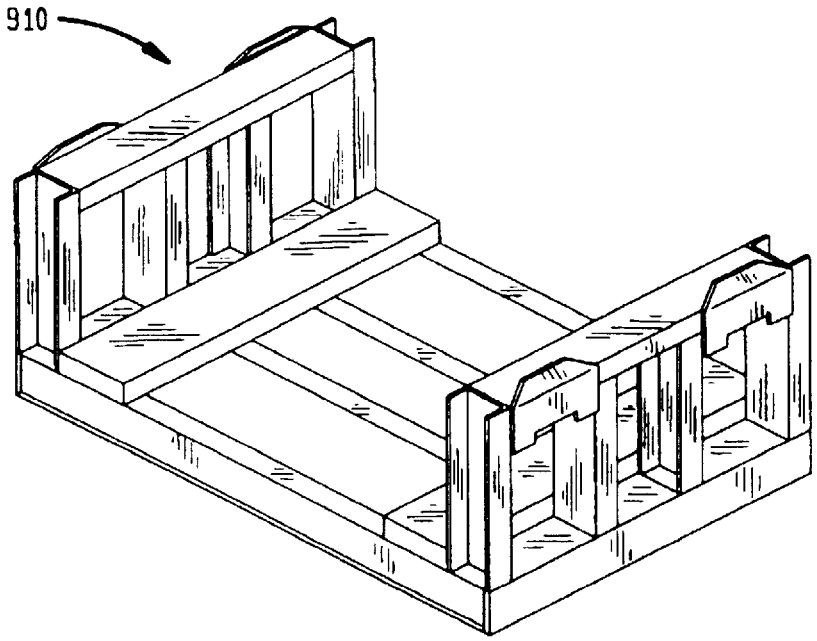
FIG. 9 is an isometric representation of an alternative embodiment of the present invention particularly directed to slit coil transportation and storage.
Figure 10:
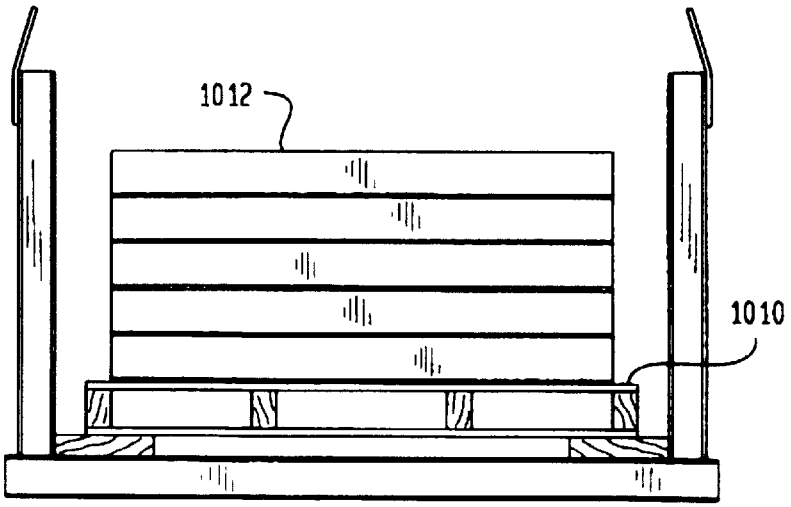
FIG. 10 is an elevational representation of the alternative embodiment of FIG. 9.

FIG. 9 is an isometric representation of an alternative embodiment of the present invention. A module 910 is specifically designed to accommodate slit coils that are vertically stacked with the edges of the cylinders parallel to the base of the module. An elevational representation of this embodiment is shown in FIG. 10. As shown, in this specific illustrative embodiment, module 910 accommodates a wood pallet 1010 that supports slit coils 1012, although module 910 may also be used without pallet 1010. In addition, the slotted side bar is arranged to accommodate the guide protuberance, which in this specific illustrative embodiment of the invention, is provided with an interengagement portion arranged to be angled with respect to a plane defined by the stanchions.

Presently, many manufacturers utilize wood pallets such as pallet 1010 to transport and store slit coils. The principal method of moving such pallets is with the use of a fork lift. A number of advantages derive from using module 910 to transport and store slit coils 1012. First, lifting of coils 1012 can be accomplished using container lifter attachment 710, spreader beam 810 or fork lift (not shown). Second, use of module 910 is safer than using only pallet 1010. Particularly, module 910 can be safely stacked without compression of the structure. Stacking of pallet 1010 may be unstable due to compression of the wood. Third, module 910 is reusable, whereas pallet 1010 has an extremely limited useful life. Additionally, the use of module 910 in addition to, or in place of, pallet 1010 allows slit coils to be safely and uniformly stacked, generally up to 6 modules high. Such a stack of modules can, in one highly advantageous embodiment, accommodate up to 20,000 pounds of coiled material.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A system for stacking cylindrical materials having an outer surface and an interior surface, the system comprising:

a plurality of modules for storing the cylindrical materials, each module including:

a base member having four corners;

four stanchions respectively disposed at the four corners of said base member, each stanchion being formed of an associated pair of parallel support members, and connected at a lowermost end to said base member, said four stanchions being arranged in pairs;

a pair of lifting members, each lifting member being associated with and interconnecting the stanchions of an associated pair of stanchions, said lifting member being disposed intermediate with respect to the associated pair of stanchions and connected to the inward most ones of the parallel support members of the associated pair of stanchions;

load distribution means for distributing a load applied to said lifting member;

a guide protuberance associated with each of said stanchions, said guide protuberance being arranged to couple the associated pair of parallel support members of the associated stanchion; and means for inter-engaging said guide protuberances associated with another of said modules, said means for inter-engaging being disposed at the lowermost ends of said stanchions in spaced relation to said guide protuberances of said module and arranged intermediate of the associated pair of parallel support members.

2. The system of claim 1 wherein said guide protuberance comprises a tapered plate.

3. The system of claim 1 wherein said means for inter-engaging comprises a slotted side bar of said base defining a slot through which a guide protuberance of another of said modules is received.

4. The system of claim 3 wherein the slotted side bar is arranged to accommodate said guide protuberance, and said guide protuberance is provided with an interengagement portion arranged to be angled with respect to a plane defined by said stanchions.

5. The system of claim 1 wherein said means for distributing load comprises a curved indentation in said lifting member.

6. The system of claim 5 wherein said lifting member further comprises a supportive rim, said supportive rim being arranged to reinforce a load bearing edge of said lifting member.

7. The system of claim 1 wherein said base member comprises a saddle for receiving and stabilizing said coiled material.

8. The system of claim 7 wherein said saddle comprises a pair of inverted V-shaped saddle rails disposed on said base member.

9. The system of claim 1 wherein each of said modules further comprises a pair of straps and a pair of associated ratchet mechanisms attached to said base member for securing the cylindrical materials along the outer surfaces of the cylindrical materials.

10. The system of claim 1 wherein each of said modules further comprises a strap and an associated ratchet mechanism attached to said base member for securing the cylindrical materials along the inner axial surface of the cylindrical materials.

11. The system of claim 1 wherein each of said modules further comprises a means for retaining a slit-coil separator.

12. The system of claim 11 wherein said means for retaining a slit-coil separator is disposed within each of said stanchions.

13. The system of claim 11 wherein said means for retaining a slit-coil separator is disposed intermediate with respect to each pair of stanchions.

14. The system of claim 11 further including a slit coil separator having a hand grab, a retention notch, and a protective lining.

15. A storage container for storing cylindrical materials comprising:

a rectangular base having a general plane, said rectangular base being formed of a first and second pair of opposing parallel side bars, an interior cross member connected to and spanning between the first pair of side bars, and a retention plate disposed between the interior cross member and a side bar from the second pair, the retention plate having a working surface that is transverse to the general plane of the rectangular base and defining a guide receptacle with an associated one of the side bars of the first pair of side bars;

at least two pairs of upstanding protective side members, each side member having first and second ends, the first end being attached at a right angle to a side bar from the first pair of side bars, and the second end having an attached interlocking arrangement, at least one of said upstanding protective side members being arranged to overlie the guide receptacle;

at least two lateral support members having load bearing edges, each lateral support member spanning between and attached to paired ones of said upstanding protective side members; and a load distribution arrangement disposed on each of said lateral support members.

16. The storage container of claim 15 wherein the interlocking arrangement comprises a guide plate having a guide surface.

17. The storage container of claim 16 wherein the guide plate is provided with a tapered engagement portion.

18. The storage container of claim 17 wherein the guide surface is arranged parallel to the plane of the working surface of the retention plate.

19. The storage container of claim 15 wherein the load distribution arrangement comprises a curved indentation in said lateral support member.

20. The storage container of claim 19 wherein each of said lateral support members comprises a supportive rim for reinforcing the load bearing edge of said lateral support member.

21. The storage container of claim 15 wherein said rectangular base comprises a saddle for receiving and stabilizing cylindrical materials.

22. The storage container of claim 21 wherein the saddle comprises a pair of inverted V-shaped saddle rails, the rails spanning between and being attached to the second pair of side bars.

* * * * *